United States Patent [19]

Groner

[11] 4,064,862

[45] Dec. 27, 1977

[54] COMPOUND BOW

[75] Inventor: Norman Arlo Groner, Kalkaska, Mich.

[73] Assignee: Victor United, Inc., Chicago, Ill.

[21] Appl. No.: 672,150

[22] Filed: Mar. 31, 1976

[51] Int. Cl.[2] ..... F41B 5/00

[52] U.S. Cl. ..... 124/23 R; 124/88

[58] Field of Search ..... 124/24 R, 23 R, 86, 124/88, 90, 89, 29, 23, 24; 242/155 R, 154, 75; 273/26 D; 272/DIG. 4

[56] References Cited

U.S. PATENT DOCUMENTS

| | | | |
|---|---|---|---|
| 717,274 | 12/1902 | Reardon | 242/154 |
| 3,649,008 | 3/1972 | Zinken et al. | 272/DIG. 4 |
| 3,854,467 | 12/1974 | Hofmeister | 124/24 R |
| 3,945,368 | 3/1976 | Jones | 124/24 R |
| 3,967,609 | 7/1976 | Frydenlund | 124/90 |

OTHER PUBLICATIONS

"Archery" Magazine; Aug. 1975; p. 10.

*Primary Examiner*—Richard C. Pinkham
*Assistant Examiner*—William R. Browne
*Attorney, Agent, or Firm*—Emory L. Groff, Jr.

[57] ABSTRACT

A compound bow having limb members adjustably pivotally mounted on opposite ends of a handle member by a limb adjustment assembly including an arcuate rib and groove connection and an adjustable bolt fixedly holding the limb members in various adjusted positions relative to the handle member; a draw weight adjustment assembly mounted on each outer end portion of the handle member having a pulley member pivotally adjustably movable to various draw weight positions; an eccentric wheel and idler pulley assembly mounted on the outer end portion of each limb member; and a cable member associated with each eccentric wheel which has a terminal portion attached to one outer end portion of the handle member; a second portion extending from the handle portion to an idler pulley at the outer end of the adjacent limb member; a third portion extending from the idler pulley to the draw weight adjustment pulley; a fourth portion extending from the draw weight adjustment pulley to an eccentric wheel mounted on the outer end portion of the other opposite limb member; and a fifth portion extending from the eccentric wheel to the draw string.

10 Claims, 8 Drawing Figures

COMPOUND BOW

BACKGROUND AND SUMMARY OF THE INVENTION

This invention relates to archery bows and more particularly, to compound-type archery bows employing cables, cams and pulleys.

While compound-type bows have been known for some time, such bows have not been fully accepted by archers for many reasons, among which are difficulties in achieving and maintaining satisfactory operation and performance of such bows. Compound bows utilize relatively complicated mechanisms which must be operated in unison in predetermined cooperative relationship in order to achieve and maintain satisfactory operational characteristics commonly referred to, at least in part, as tuning and timing characteristics. In addition, some compound bows have been rather unsightly with various appendages detracting from the appearance of such bows.

A primary objective of the present invention is to provide a compound bow which is reliable in operation and the tuning and timing characteristics of which may be established at the time of manufacture and assembly without need for subsequent adjustment by archers while at the same time enabling draw weight adjustment to suit the individual needs and preferences of archers. Another objective is to provide a compound bow having simplified components which are integrated with the basic bow structure to provide a more pleasing appearance while at the same time streamlining the bow to avoid protuberances which make the bow unnecessarily unwieldy in handling and usage, particularly in use for hunting. Another objective is to provide adjustment apparatus by which the positions of various adjustable parts may be correlated and adjustments, as well as replacements of various parts, easily accurately accomplished.

The foregoing and other objectives have been attained by the provision of new and improved adjustable mounting means for adjustably mounting limb members on a handle member including a new and improved arcuate rib and socket connection with an adjustment bolt member; a new and improved eccentric wheel and idler pulley assembly; a new and improved draw weight adjustment and cable attachment assembly; and a new and improved arrangement and attachment of a pair of cable members relative to the bow limb members and the handle member.

BRIEF DESCRIPTION OF THE DRAWING

A presently preferred and illustrative form of the invention is shown in the accompanying drawing in which.

THE BOW IN GENERAL

Figure 1:
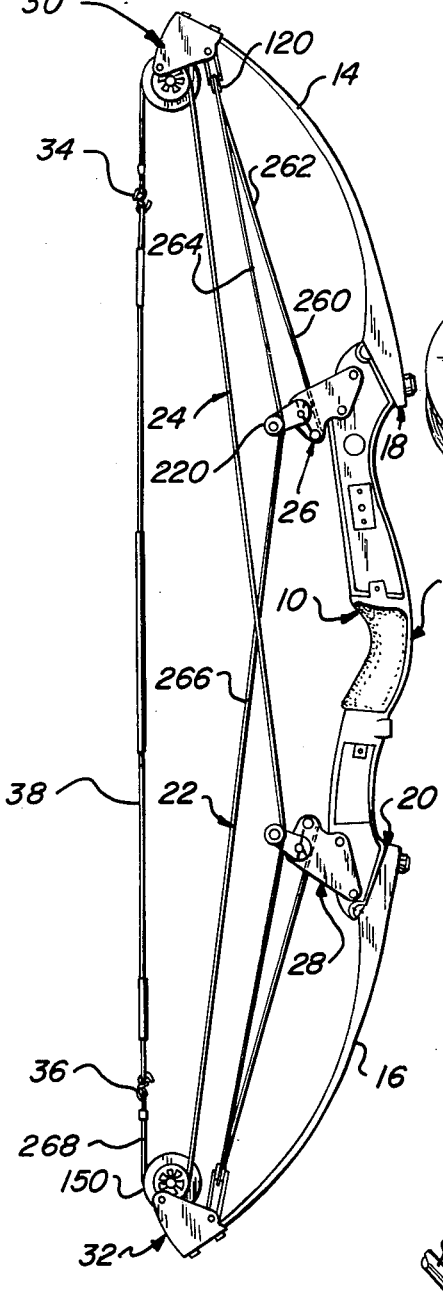
FIG. 1 is a side elevational view of a compound bow.

In general, as shown in FIG. 1, a compound bow 10, embodying illustrative presently preferred forms of the invention, comprises a handle member 12, which may be made of cast metal; a pair of limb members 14, 16; adjustable limb mounting assembly means 18, 20 on the opposite ends of the handle member and on the inner ends of the limb members; a pair of cable members 22, 24; adjustable draw weight and cable attachment assembly means 26, 28 fixedly mounted on outer opposite end portions of the handle member; a pair of cable receiving idler pulley and eccentric wheel assembly means 30, 32 fixedly mounted on the outer end portions of the limb members; and a pair of S-hook cable attachment members 34, 36 connecting the cable members to a draw string member 38.

Adjustable Limb Mounting Assembly Means

Figure 8:
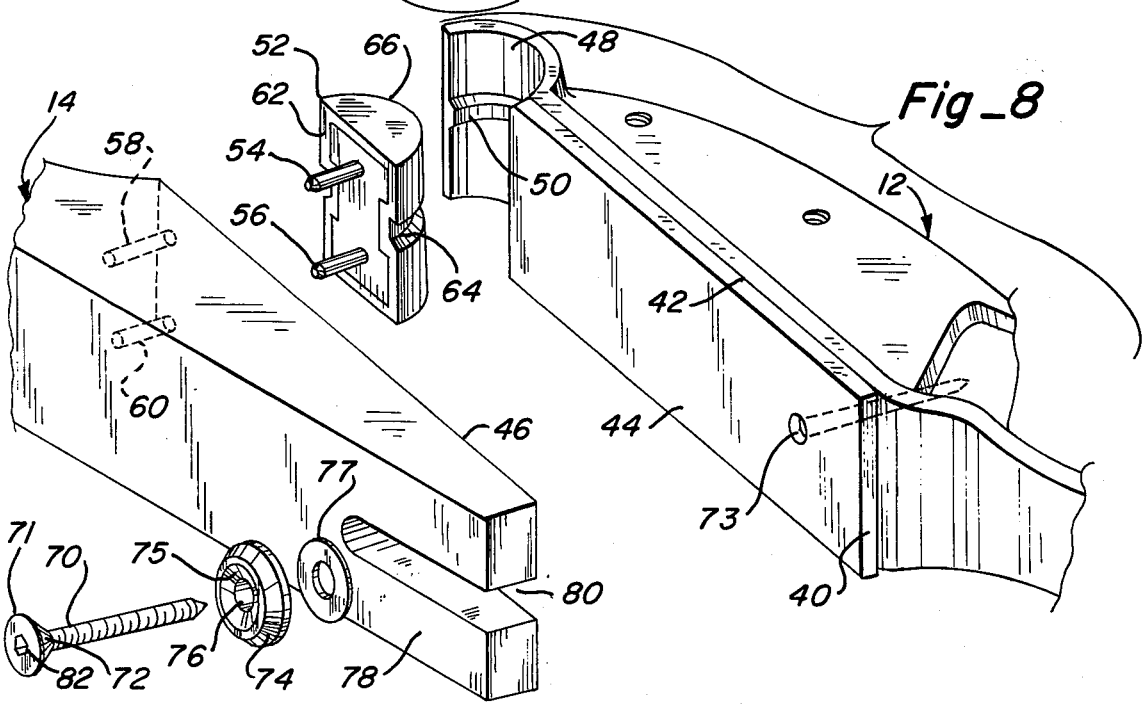
FIG. 8 is an enlarged exploded perspective view of a limb mounting assembly of the bow of FIG. 1.

Referring now to FIGS. 1 and 8, each of the adjustable limb mounting assembly means 18, 20 comprises a soft felt-like spacer member 40, adapted to be abuttingly fixedly supported on a corresponding flat surface 42 on the outer end portion of the handle member and providing a flat outwardly facing abutment surface 44 generally corresponding to a flat inwardly facing abutment surface 46 on the inner end portion of the limb members 14, 16. A pivotable limb support means in the form of a semi-circular socket or groove 48 is formed at the end of the handle portion and extends transversely thereacross such that the plane of surface 44 is generally diametrically related to groove 48. A semi-circular rib 50 is centrally located in groove 48.

The pivotal limb support means further comprises a semi-cylindrical rib member 52 having attachment pin members 54, 56 adapted to be received in pin holes 58, 60 to fixedly attach rib member 52 to the limb member with surface 62 abutting surface 46. A semi-cylindrical groove 64 is centrally located on the outer semi-cylindrical surface 66 of member 52, the surface 66 being pivotally supported on the corresponding surface of groove 48 and the groove 64 receiving the corresponding rib portion 50.

Limb adjustment means are provided to adjustably secure the limb members on the handle member in the form of a threaded bolt member 70 having a bolt head 71 providing a tapered load bearing surface 72 and threadably mounted in threaded bore 73 in the handle member. A bearing member 74 has a tapered abutment surface 75 corresponding to surface 72 and a bolt receiving opening 76. A washer member 77 is located between bearing member 74 and the outer flat surface 78 of the limb member. An elongated slot 80 is provided in the end of the limb member to loosely receive the bolt member 70.

The mounting arrangement is such that the bolt member 70 may be tightened against the tension forces of the cables 22, 24 and bow string 38 to obtain load bearing engagement of the end portion of the limb member with the end portion of the handle member. In order to tighten and loosen the bolt member, a polygonal bore 82, adapted to receive a tool such as an Allen wrench, is provided in head portion 71. The position of the limb member relative to the handle member may be adjustably varied by varying the location of bolt member 70 relative to the handle member. Such adjustment is enabled by groove 48 and rib 52 which provide curved semi-cylindrical load bearing surfaces to enable sliding arcuate movement of the limb member relative to the bolt member with rib 50 and groove 64 maintaining alignment therebetween. In this manner, the eccentric wheel means 30, 32 on the outer ends of the limb members 14, 16 may be variously uniformly located along arcs having centers at the pivotal axes provided by grooves 48 and ribs 52.

Cable Receiving Idler Pulley and Eccentric Wheel Assembly Means

Figure 2:
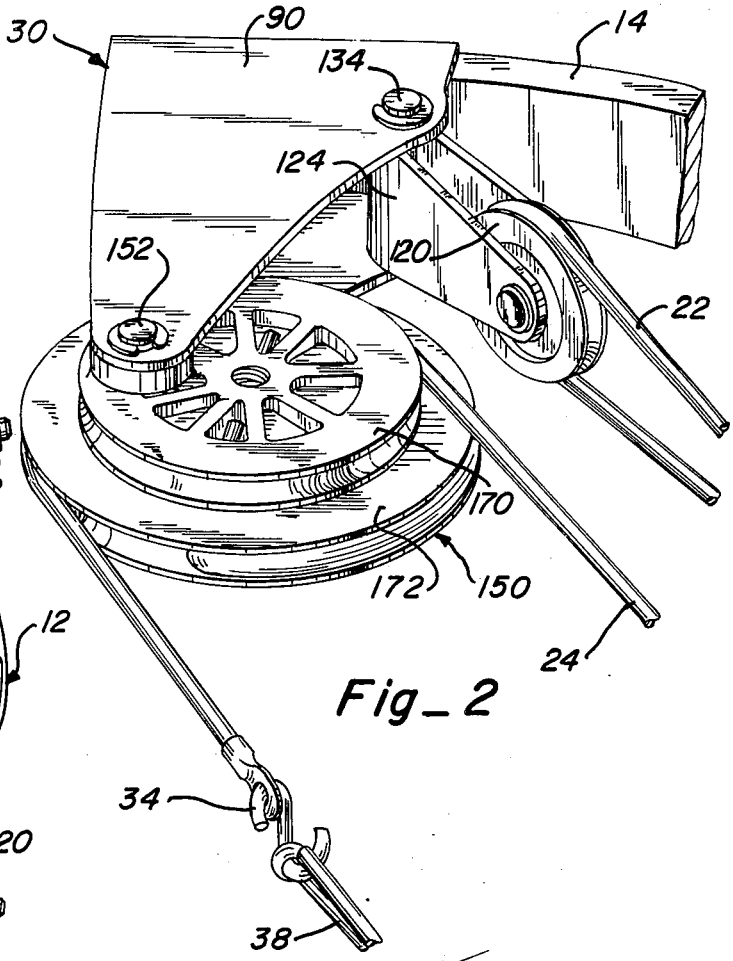
FIG. 2 is an enlarged perspective view of an eccentric wheel and pulley assembly of the bow of FIG. 1.
Figure 3:
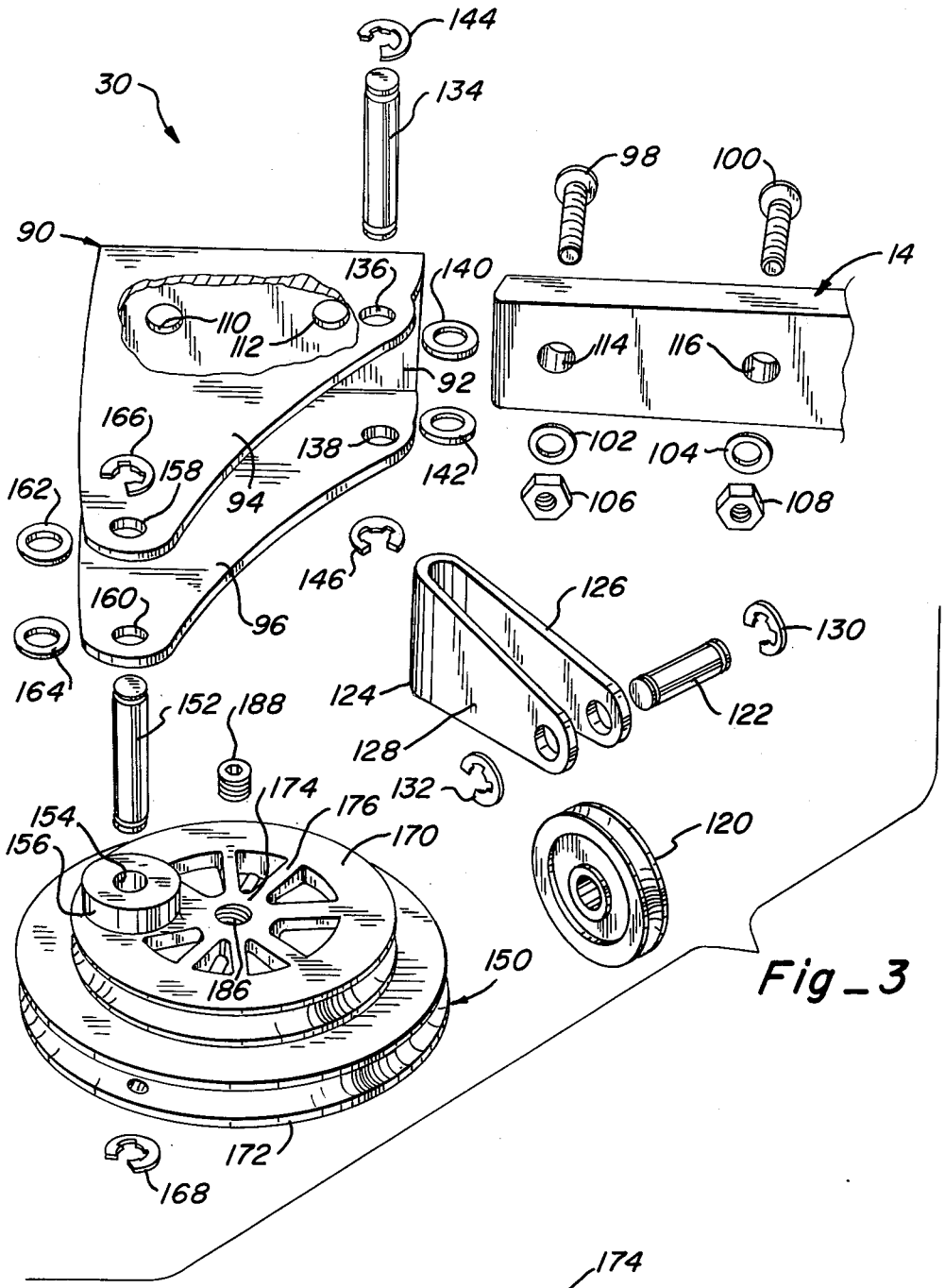
FIG. 3 is an enlarged exploded perspective view of the apparatus of FIG. 2.
Figure 4:
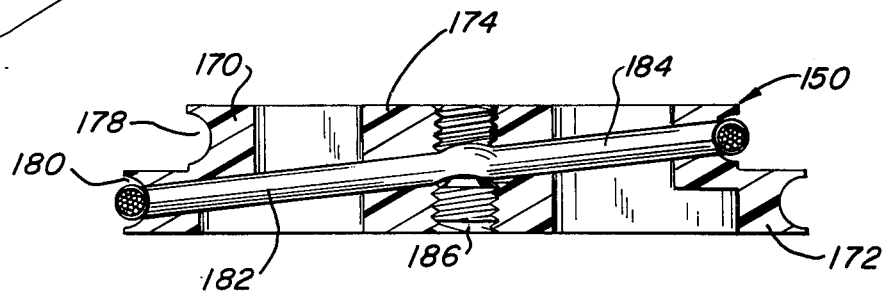
FIG. 4 is a cross-sectional view of an eccentric wheel of the apparatus of FIG. 3.

Referring now to FIGS. 2, 3 and 4, the cable receiving idler pulley and eccentric wheel assembly means 30, 32, each comprise a main mounting bracket member 90 having a mounting plate portion 92 and spaced parallel flange portions 94, 96. The bracket member is fixedly mounted on the outer end portions of the limb member 14 by suitable fastening members 98, 100, 102, 104, 106 and 108 by means of aligned holes 110, 112 and 114, 116. An idler pulley wheel member 120 is freely rotatably mounted on a pin member 122 supported in a support bracket member 124 between spaced flange portions 126, 128 by retainer ring members 130, 132. The support bracket member 124 is pivotally mounted on bracket member 90 between flange portions 94, 96 by a connecting pin member 134, having an axis transverse to the axis of pin member 122, mounted in holes 136, 138 and secured thereto by washer members 140, 142 and retainer rings 144, 146.

The cable receiving idler pulley and eccentric wheel means assemblies 30, 32, each further comprise an eccentric wheel member 150 rotatably mounted between flange portions 94, 96 on a pin member 152 in a bore 154 in member 150 located in a hub portion 156 in axially offset eccentric relationship to the central axis of the wheel member. Pin member 152 is mounted in aligned bores 158, 160 with washers 162, 164 between the member 150 and the flange portions 94, 96, and held by retainer ring members 166, 168. The eccentric wheel member is preferably made of one piece of glass filled Nylon material with a relatively small diameter rim portion 170 and a relatively large diameter rim portion 172 connected to a central hub portion 174 by radially extending spoke portions 176. A pair of annular cable grooves 178, 180 are provided on the periphery of the rim portions 170, 172 with radially extending bore means 182, providing a cable passage connecting the grooves 178, 180. An axially extending threaded bore 186 intersects cable passage 182 and receives a threaded set screw 188 by which the position of the cable relative to the wheel member 150 may be adjustably fixed. As is conventional, a portion of the cable supported in groove 178 and a portion supported in groove 180 are connected by a portion extending through passages 182.

Adjustable Draw Weight and Cable Attachment Assembly Means

Figure 5:
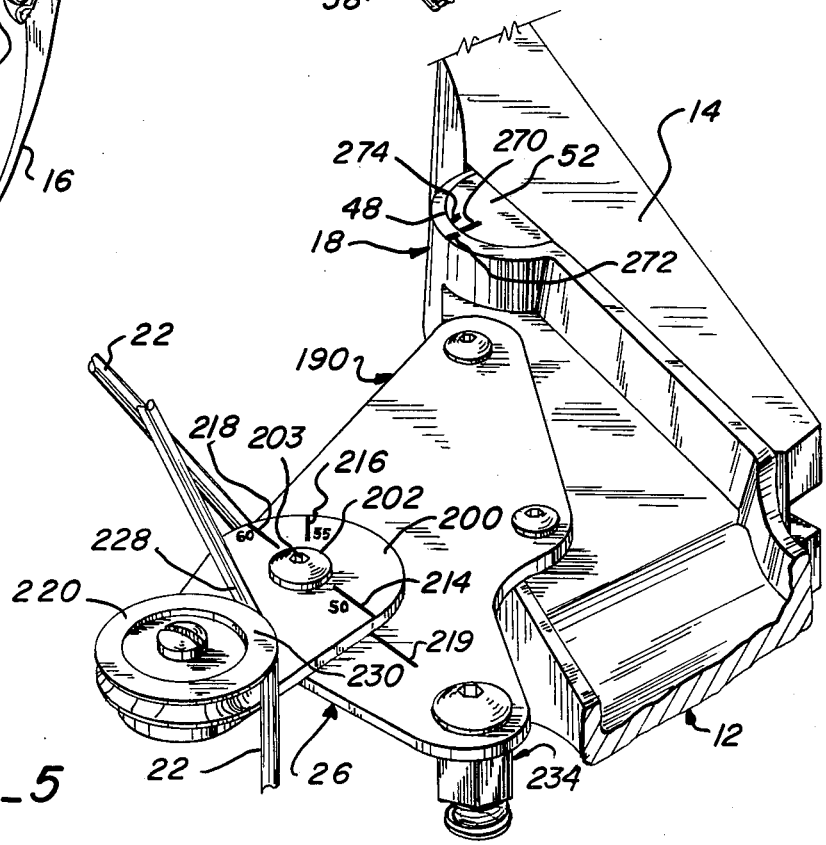
FIG. 5 is an enlarged perspective view of an adjustable draw weight and cable attachment assembly of the bow of FIG. 1.
Figure 6:
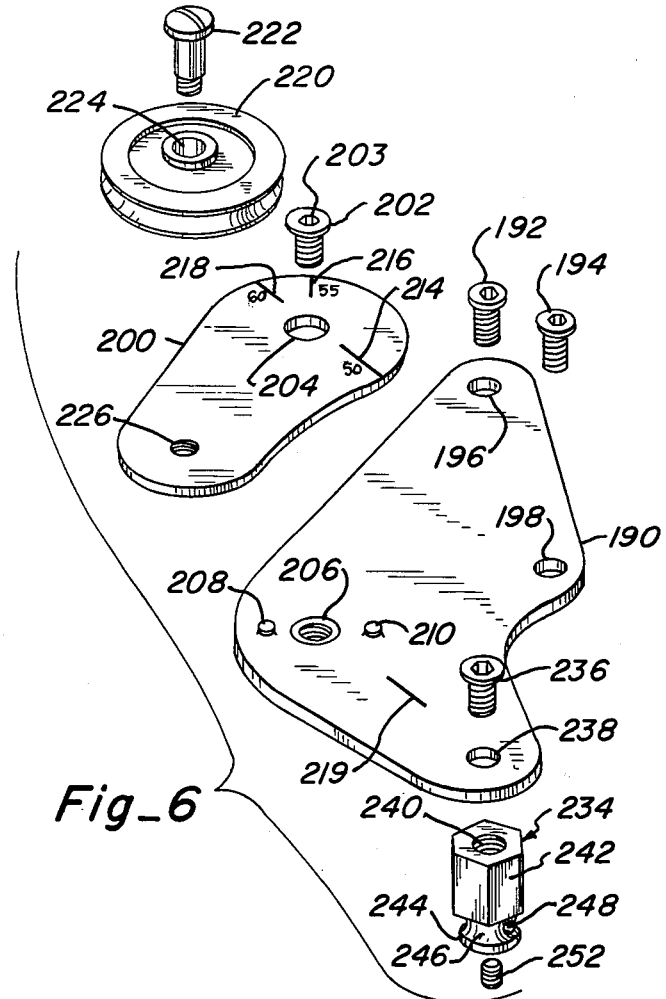
FIG. 6 is an enlarged exploded perspective view of the apparatus of FIG. 5.
Figure 7:
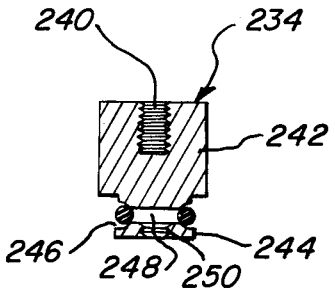
FIG. 7 is a cross-sectional view of a cable attachement shaft of the apparatus of FIG. 6.

Referring now to FIGS. 5, 6, and 7, each of the adjustable draw weight and cable attachment assembly means 26, 28 comprises a mounting plate member 190 fixedly attached to the outer end portion of the handle member 12 by suitable fastening members 192, 194, extending through holes 196, 198, and received in threaded holes in the handle member. The mounting plate 190 extends generally outwardly, rearwardly and inwardly from the handle member at generally right angles to the limb mounting surface 42.

The adjustable draw weight means comprises a pivotal lever member 200 adjustably pivotally fixedly attached to plate member 190 by a bolt member 202 extending through a bore 204 and received in a threaded bore 206 in plate member 190. A polygonal wrench socket 203 is provided in bolt member 202 for loosening and tightening thereof. Pivot lever locating and retaining means are provided in the form of protusions 208, 210 on the mounting plate 190 which are receivable in corresponding cavities in the lever member 200 in various adjusted positions at, for example, fifty, fifty-five, and sixty pounds draw weights, represented by position lines 214, 216, 218, marked on the outer surface of lever member 200. A reference mark 219 is placed on plate member 190.

An idler pulley member 220 is rotatably mounted on the outer end portion of lever member 200 by a threaded fastening member 222 extending through a central bore 224 in pulley member 220 and fixedly received in threaded bore 226 in the lever member. As shown in FIG. 5, a portion 228 of the cable rests against and is held by a portion 230 of the pulley member 220, next adjacent the handle member 12, to create tension in the cable member at a desired level corresponding to predetermined draw weights which may be calibrated at the factory for each bow.

The cable attachment means comprises a shaft member 234 adjustably rotatably fixedly mounted on the outer end portion of plate member 190 by a threaded fastening member 236 extending through a bore 238 and received in a threaded bore 240 in shaft member 234. Member 234 has an inner polygonally shaped body portion 242, adapted to receive a wrench, and an outer cylindrical cable attachment portion 244 with a cable receiving groove 246 and a cable cross passage 248. A threaded bore 250 intersects passage 248 and receives a threaded set screw member 252 which engages and retains the terminal portion of the cable within passage 248.

Assembly and Operation

In the assembled and operative position, FIG. 1, the arrangement is such that each cable means 22, 24 comprises a first terminal portion 260 fixedly attached to the bow handle 12 by shaft member 234 and plate member 190; a first intermediate portion 262 extending from the cable attachment means to the idler pulley means 120 at the outer end portion of the limb member 14; a second intermediate portion 264 extending from the idler pulley means 120 to the draw weight adjustment pulley means 220 attached to the bow handle member 12 by lever 200 and plate 190; a third intermediate portion 266 extending from the draw weight adjustment pulley means 220 to the eccentric wheel means 150 on the outer end portion of the other limb member 16; and a second terminal portion 268 extending from the eccentric wheel means 150 to one end of the draw string 38 for attachment thereto by hook member 36.

The bow is adjusted at the factory during manufacture and assembly for a peak draw weight of, for example, fifty pounds. The weight adjustment lever arm members 200 are calibrated to enable increases in draw weight of, for example, fifty five or sixty pounds by repositioning of the lever arm members 200. The apparatus is arranged and designed to enable such adjustment of the draw weight in a simple manner without affecting the tuning of the bow. The weight adjustment is accomplished by simply removing the cable from the weight adjustment pulley 220 which is permitted by the elasticity of the cable limb system. Then an Allen wrench may be inserted in socket 203 of bolt 202 to loosen pivot lever arm 200, which then may pivotally be located at any indicated draw weight position with one of the marks 214, 216, 218 aligned with reference mark 219. Then bolt 202 is tightened to fixedly locate the lever arm member in the selected position and the cable is replaced on the adjustment pulley 220.

The positions of limb members 14, 16 relative to the handle member 12 are adjusted at the factory to provide proper tuning for the bow and alignment marks 270, 272 are provided on the rib member 52 and the socket portion 48 of the handle member 12. In addition, a mark 274 may be provided on the rib member 52 to indicate a maximum loosened position whereat changing of string member 38 may be most advantageously accomplished. In order to change the string member, an Allen wrench is inserted in sockets 82 of bolt members 70 to rotate the bolt members until mark 272 is aligned with mark 274, whereat the tension in the cable members 22, 24 will be sufficiently relieved to enable replacement of the string member. Then, with the new string member attached to the cable members and the cable members properly associated with the idler pulley members 120, the bolt members 70 may be retightened to align marks 270, 272. Then the cable members may be stretched over and mounted on the draw weight adjustment pulley members 220.

The cable members 22, 24 may be replaced, if necessary, by loosening bolt members 236 which enables rotation of attachment shaft members 234. The cable members may be removed from shaft members 234 by loosening set screws 252. Since the need for cable replacement occurs relatively infrequently, the original cable attachment procedure done at the factory enables aligned tuning of the bow which will be normally maintained during the life of the bow. If desired, suitable adjustment marks may also be associated with the cable attachment means to provide suitable reference positions.

While the inventive concepts have been embodied in an illustrative and presently preferred form of compound archery bow as hereinbefore described, it is contemplated that the inventive concepts may be variously otherwise embodied in alternative forms. Consequently, it is intended that the following claims be construed to include alternative embodiments of the inventive concepts except insofar as limited by the prior art.

The invention claimed is:

1. A compound bow for propelling an arrow comprising:

handle means for gripping and holding the bow;

a pair of limb means extending outwardly from opposite ends of said handle means for storing energy to propel the arrow;

a pair of cable means attached to the bow for causing flexing movement of said limb means;

a draw string means connected to said cable means for association with an arrow;

eccentric wheel means attached to outer end portions of each of said limb means for association with said cable means;

idler pulley means attached to outer end portions of each of said limb means for association with said cable means;

cable attachment means mounted on each of the outer end portions of said handle means for fixedly attaching said cable means to said bow;

draw weight adjustment means including pulley means mounted on each of the outer end portions of said handle means for association with said cable means;

said draw weight adjustment pulley means comprising:

variably adjustable mounting means for mounting said draw weight adjustment pulley means relative to said handle means whereby said draw weight adjustment pulley means is variably locatable relative to said handle means to vary the tension in said cable means;

each of said cable means having a first terminal portion attached to one of the outer end portions of said handle means by one of said cable attachment means, a first intermediate portion extending from said one cable attachment means to one of said idler pulley means on the outer end portion of the one limb means extending outwardly from the one of the outer end portions of said handle means;

a second intermediate portion extending from said one idler pulley means to one of said draw weight adjustment pulley means on the one of the outer end portions of said handle means;

a third intermediate portion extending from said one of said draw weight adjustment pulley means to one of said eccentric wheel means on the outer end portion of the other limb means; and a second terminal portion extending from said one of said eccentric wheel means and connected to one adjacent end of said draw string means.

2. The invention as defined in claim 1 and wherein said mounting means comprising:

attachment means for securing said draw weight pulley means on said handle means whereby said cable means is removable from and replaceable on said draw weight pulley means.

3. The invention as defined in claim 2 and wherein said attachment means comprising:

pivotal lever arm means for supporting said draw weight adjustment means and for mounting said draw weight attachment means on said handle means, and adjustable connecting means for mounting said pivotal lever arm means on said handle means whereby said lever arm means and said draw weight adjustment means are variably positionable relative to said handle means and said cable means.

4. The invention as defined in claim 3 and further comprising:

indicia means on said pivotal lever arm means for locating said lever arm means in predetermined positions relative to said handle means whereat said cable means is subject to predetermined draw weight tension.

5. The invention as defined in claim 4 and further comprising:

mounting plate means fixedly attached on the outer end portion of said handle means and extending outwardly rearwardly therefrom, and said pivotal lever arm means being adjustably pivotally mounted on said mounting plate means.

6. The invention as defined in claim 5 and further comprising:

indicia means on said mounting plate means for cooperation with said indicia means on said lever arm means.

7. The invention as defined in claim 5 and further comprising:

attachment means on said mounting plate means for attaching said cable attachment means.

8. A compound bow for propelling an arrow comprising:

handle means for gripping and holding the bow;

a pair of limb means extending outwardly from opposite ends of said handle means for storing energy to propel said arrow;

a pair of cable means attached to the bow for causing flexing movement of said limb means;

a draw string means connected to said cable means for association with an arrow;

eccentric wheel means attached to outer end portions of each of said limb means for association with said cable means;

idler pulley means attached to outer end portions of each of said limb means for association with said cable means;

cable attachment means mounted on each of the outer end portions of said handle means for fixedly attaching said cable means to said bow;

draw weight adjustment means including pulley means mounted on each of the outer end portions of said handle means for association with said cable means;

each of said cable means having a first terminal portion attached to one of the outer end portions of said handle means by one of said cable attachment means, a first intermediate portion extending from said one cable attachment means to one of said idler pulley means on the outer end portion of the one limb means extending outwardly from the one of the outer end portions of said handle means;

a second intermediate portion extending from said one idler pulley means to one of said draw weight adjustment pulley means on the one of the outer end portions of said handle means;

a third intermediate portion extending from said one of said draw weight adjustment pulley means to one of said eccentric wheel means on the outer end portion of the other limb means; and a second terminal portion extending from said one of said eccentric wheel means and connected to one adjacent end of said draw string means;

said draw weight adjustment pulley means comprising:

variably adjustable mounting means for mounting said draw weight adjustment pulley means relative to said handle means whereby said draw weight adjustment pulley means is variably locatable relative to said handle means to vary the tension in said cable means, said mounting means comprising:

attachment means for securing said draw weight pulley means on said handle means whereby said cable means is removable from and replaceable on said draw weight pulley means by stretching said cable means relative to said draw weight pulley means, said attachment means comprising:

pivotal lever arm means for supporting said draw weight adjustment means and for mounting said draw weight attachment means on said handle means, and adjustable connecting means for mounting said pivotal lever arm means on said handle means whereby said lever arm means and said draw weight adjustment means are variably positionable relative to said handle means and said cable means, indicia means on said pivotal lever arm means for locating said lever arm means in predetermined positions relative to said handle means whereat said cable means is subject to predetermined draw weight tension, mounting plate means fixedly attached on the outer end portion of said handle means and extending outwardly rearwardly therefrom, and said pivotal lever arm means being adjustably pivotally mounted on said mounting plate means, attachment means on said mounting plate means for attaching said cable attachment means, said cable attachment means comprising:

a shaft member adjustably rotatably fixedly mounted on said mounting plate means, a cable groove on said shaft member, a cross passage in said shaft member connecting opposite sides of said cable groove, said first terminal portion of said cable means being wound on said cable groove and extending through said cross passage, and retaining means associated with said cable means in said cross passage for fixedly retaining said cable means therewithin.

9. The invention as defined in claim 8 and wherein:

said shaft member extends laterally from one side of said mounting plate means, said pivotal lever arm means being mounted on the opposite side of said mounting plate means, and said draw weight pulley means being mounted on one side of said pivotal lever arm means opposite said one side of said mounting plate means, whereby the first intermediate portion and the second intermediate portion of said cable means are substantially laterally spaced from one another.

10. A bow for propelling an arrow comprising:

a handle member for gripping and holding the bow;

a pair of limb means extending outwardly from opposite ends of said handle means for storing energy to propel an arrow;

limb mounting means for removable and adjustable mounting of the inner end portions of said limb members on the outer end portions of said handle member;

each of said limb mounting means comprising: a first elongated flat abutment surface on the outer end portion of said handle member;

a transverse semi-cylindrical socket portion at the outer end of said first elongated flat abutment surface;

a semi-circular rib centrally located in said socket portion;

a second elongated flat abutment surface on the inner end portion of said limb member;

a transverse semi-cylindrical rib portion at the inner end of said second elongated flat abutment surface;

a semi-circular groove centrally located in said semi-cylindrical rib portion; said semi-cylindrical rib portion being mounted in rotatable supportive engagement with said semi-cylindrical socket portion with said semi-circular rib being in rotatable supportive engagement with said semi-circular groove and preventing axial displacement of said semi-cylindrical rib portion relative to said semi-cylindrical socket portion; and threaded fastening means for fixedly adjustably receiving said inner end portion of said limb member to said outer end portion of said handle member.

* * * * *